US006165266A

United States Patent [19]

Garcia

[11] Patent Number: 6,165,266

[45] Date of Patent: Dec. 26, 2000

[54] MACHINE FOR VARNISHING EASY-TO-OPEN COVERS

[76] Inventor: Jose Peñalver Garcia, Pol. Ind. el Tapiado, E-30500 Molina de Segura, Murcia, Spain

[21] Appl. No.: 09/147,927

[22] PCT Filed: Sep. 12, 1997

[86] PCT No.: PCT/ES97/00225

§ 371 Date: Mar. 19, 1999

§ 102(e) Date: Mar. 19, 1999

[87] PCT Pub. No.: WO98/04905

PCT Pub. Date: Feb. 4, 1999

[30] Foreign Application Priority Data

Jul. 21, 1997 [ES] Spain ..... 9701621

[51] Int. Cl.[7] ..... B05B 13/02

[52] U.S. Cl. ..... 118/305; 118/323; 118/324; 118/500; 413/58; 413/61

[58] Field of Search ..... 118/300, 305, 118/323, 324, 500; 413/58, 61

[56] References Cited

U.S. PATENT DOCUMENTS

| | | | |
|---|---|---|---|
| 3,094,254 | 6/1963 | Cullen et al. . | |
| 4,498,415 | 2/1985 | Tsuchiya et al. | 118/712 |
| 4,605,351 | 8/1986 | Hatcher et al. | 413/58 |
| 4,768,498 | 9/1988 | Herrick | 128/75 |
| 5,895,528 | 4/1999 | Gomariz Perez | 118/324 |

FOREIGN PATENT DOCUMENTS

| | | |
|---|---|---|
| 888768 | 2/1962 | United Kingdom . |
| 2269122 | 2/1994 | United Kingdom . |

*Primary Examiner*—Shrive Beck
*Assistant Examiner*—Jennifer Calcagni
*Attorney, Agent, or Firm*—Robert M. Schwartz

[57] ABSTRACT

A simple or double head applies varnish to the covers in a circular motion and conical projection with adjustable height by means of a varnishing gun which can be provided with an additional separator of variable thickness according to the covers; it also comprises a cover conveyor device provided with another motor, an intermittent rotation box at the outlet, and a supply box which actuates a cover positioning device and a dosing blade which collects, separates and inserts the covers in a groove of the positioning device for their supply to the conveyor device.

13 Claims, 8 Drawing Sheets

MACHINE FOR VARNISHING EASY-TO-OPEN COVERS

OBJECT OF THE MENTION

The invention proposed consists of a revarnishing machine for easy opening lids, characterised by having a single or double revolving revarnishing head and a lid transporting device.

The machine is provided with a single or double rotating motorised revarnishing head which applies varnish to the lids with a circular motion, with a conical varnish projection of adjustable height, by a revarnishing gun either with or without an additional separator of a thickness adjustable depending on the diameter of the lid to be varnished.

The lid transporting device in the baseplate of the revarnisher is complemented by a drive chain at the base of the lid feeder which has an engine connected to a intermittent wheel race which provides four starts and four stops in each turn of the engine outlet shaft, the lids being varnished one at a time during the stops.

Also object of the invention is a can feeder located in relation to the storage tower where the cans are gathered.

BACKGROUND OF THE INVENTION

Lid revarnishing machines are well known and widely used, the applicant having several patents related to devices incorporated to this type of machines.

After continuous use, this type of revarnishing machines present the problem of an uneven distribution of the width of the varnish band, producing surface finishes which may generate rejections and in any case force the manufacturer to control production frequently.

Different solutions have been attempted, without obtaining industrially viable results so far, particularly for the conical varnish projection and with diameter agreeing with the size of the incision, due to the uneven distribution of the varnish.

The applicant is not aware of revarnishers for easy opening lids which are provided with two sided, single or double revarnishing heads as well as conveyors of the type described in the present application.

DESCRIPTION OF THE INVENTION

The invention object of the present invention relates to a revarnishing machine for easy opening lids with a revolving revarnishing head, single or double, and a lid transporting device.

The head basically consists of a rotary slip driven by an above toothed pulley provided with a belt which connects with their pulleys, one of which is coupled to an electric drive motor from which the rotation is transmitted to the slip by said belt, and by a shaft fitted inside said slip; having a pneumatic revarnishing gun, with or without an additional separator which can be laterally adapted to the shaft, of a variable thickness depending on the size of the lid to be varnished, and conical bearings which absorb the axial and radial loads of the rotating head.

The slip will revolve with the shaft, turning the gun included in a recess of the slip.

As the gun turns it undergoes a circular motion which applies the varnish to the lid as a cone of adjustable height.

A three step revolving joint coupled above the head, related to the head, incorporates the varnish and air inlets of the pneumatic gun.

In addition, the revarnisher is provided with a lid transportation device with an electric motor, connected by toothed pulleys and a belt to an intermittent wheel race, starting and stopping, provided with two shafts, one at the inlet and one at the outlet, the first shaft revolving continuously, together with the motor, and the latter turning intermittently by a cam-follower mechanism which causes starts and stops to varnish the lids one at a time during the stops.

A set of gears and a link chain also transmit the movement of the motor to a lid feeder.

The lid feeder is located with relation to the lid storage tower, to place the lids on the transportation device.

The lid feeder, through a pair of helical gears placed on two perpendicular shafts, drives the shaft of a lid positioner and a discoidal dosing blade located above the positioner.

The dosing blade has peripheral flaps to receive the outer edge of the lid and inclined peripheral flaps which make the lid descend after the blade turns, directing the lids towards the lid positioner located immediately below for their separation.

The lid positioner has helical grooves which as they turn direct the outer edge of the lid towards the transporting device.

The positioner shaft has a torque limiter associated to a spring which generates a signal received by a sensor when the positioner becomes blocked, causing the automatic stoppage of the machine.

The transportation device moves the lids on conveyor belt with equidistant pull flaps and receives the intermittent motion, with starts and stops, of the wheel race outlet shaft by a set of gears.

BRIEF DESCRIPTION OF THE DRAWINGS

As a complement of the description being made and in order to aid a better understanding of the characteristics of the invention, the present descriptive memory is accompanied, as an integral part of the same, by a set of drawings where with an illustrative nature and in no case limiting, the following is shown.

PREFERRED EMBODIMENT OF THE INVENTION

Figure 1:
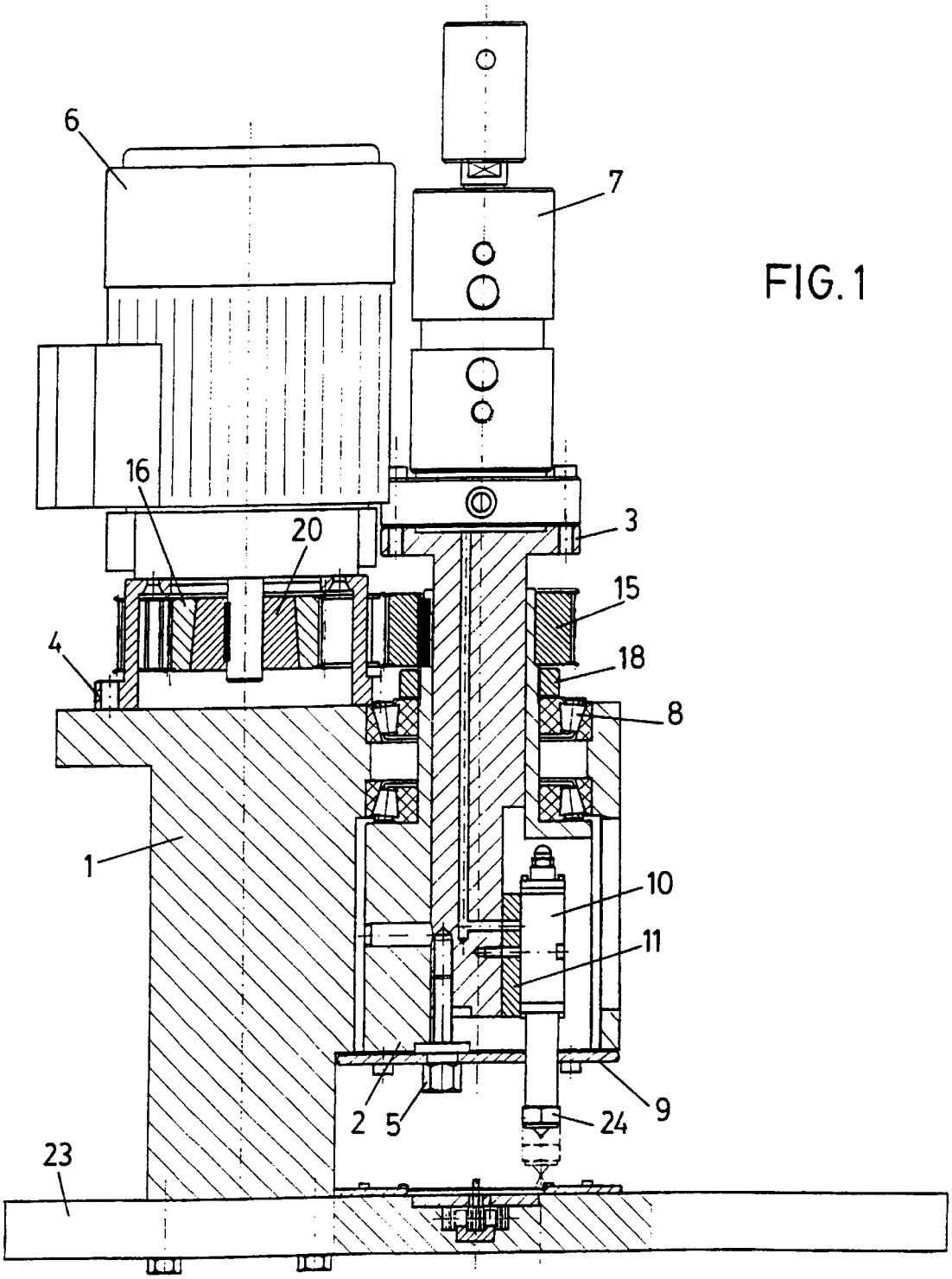
FIG. 1 shows a partial cross section elevation of the revarnisher, on the revarnishing head side, in single construction.
Figure 2:
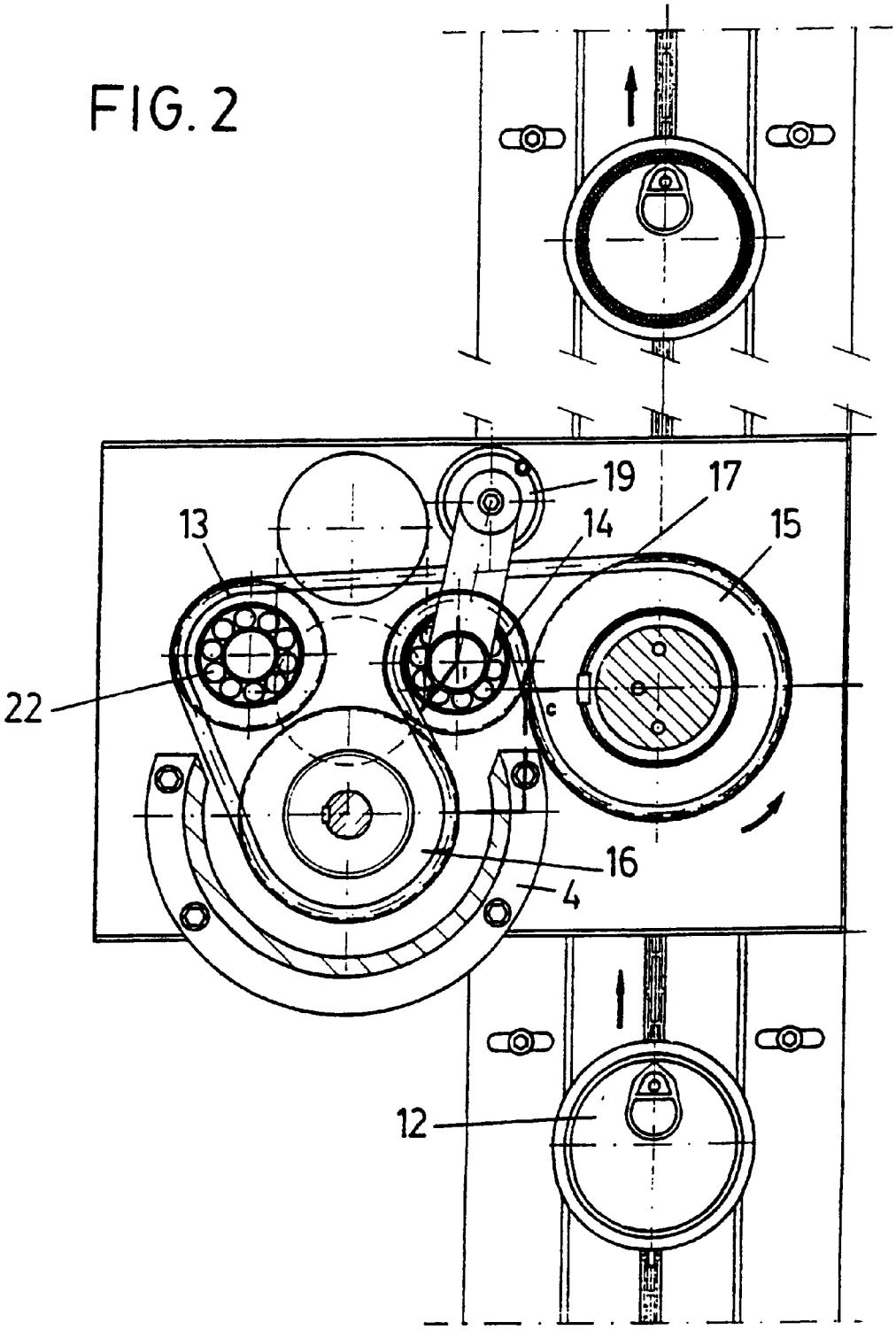
FIG. 2 is a horizontal cross section of the simple revarnishing head.
Figure 3:
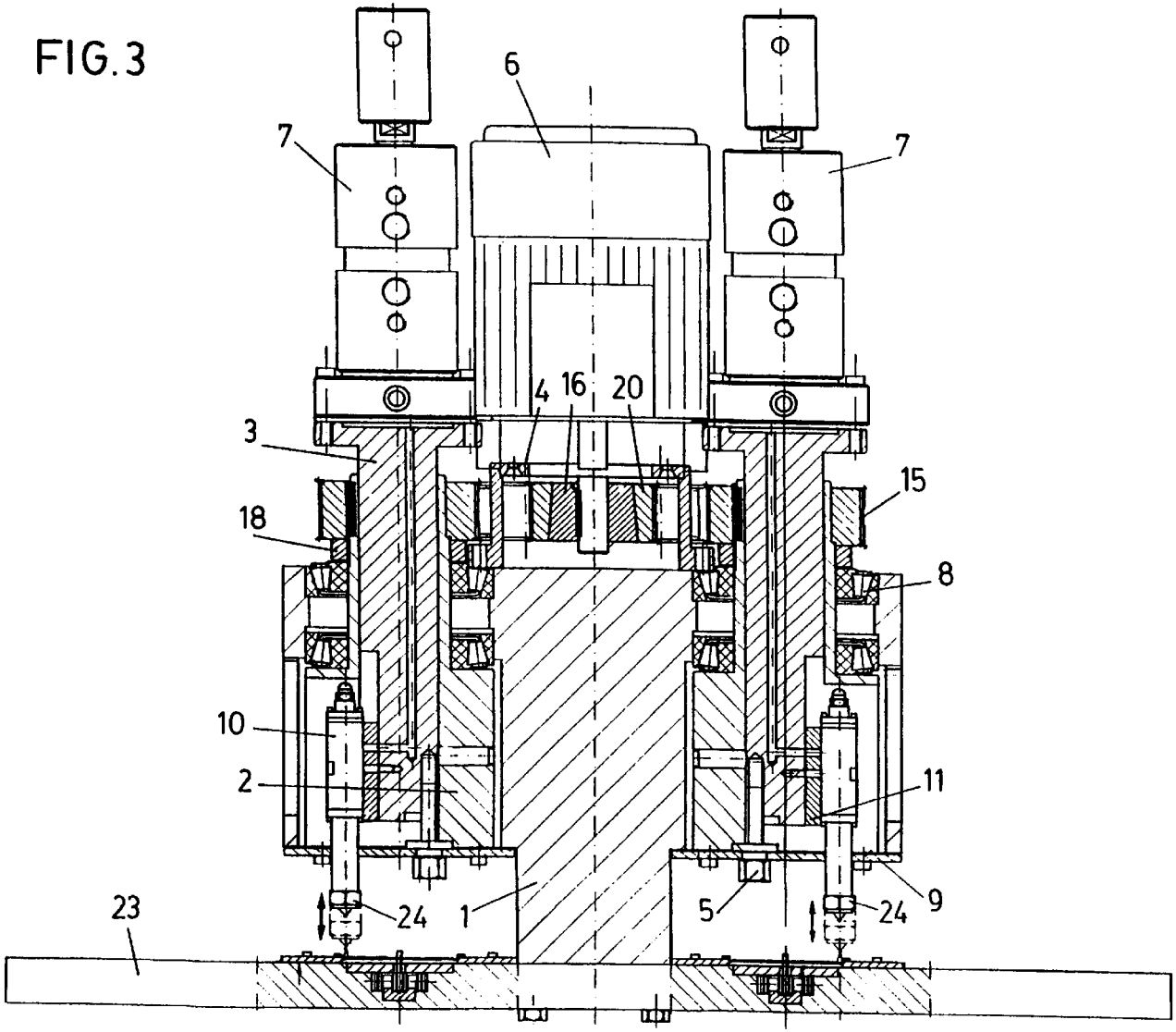
FIG. 3 shows a partial cross section elevation of the revarnishing head in double construction.
Figure 4:
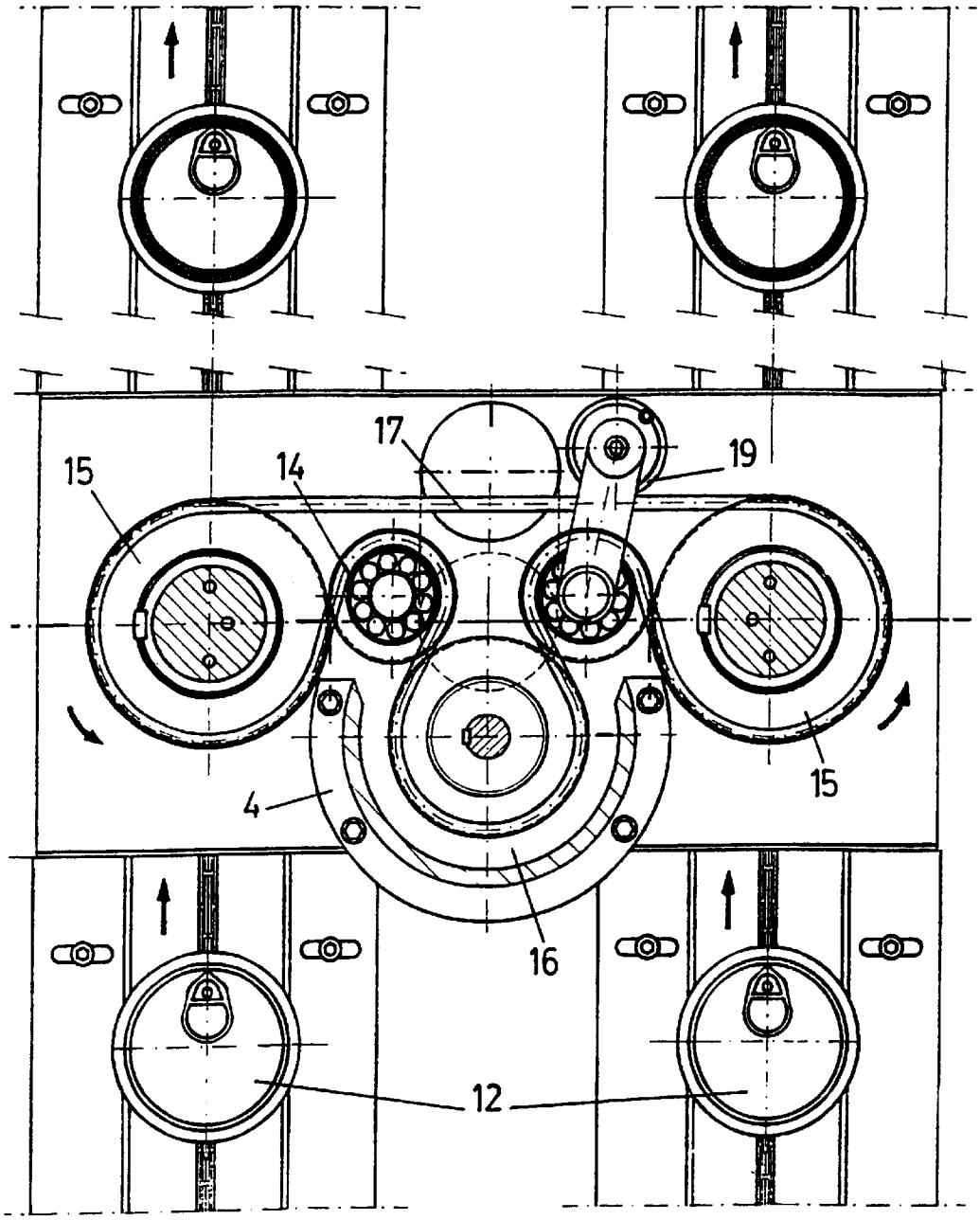
FIG. 4 is a horizontal cross section of this same head in double construction.
Figure 5:
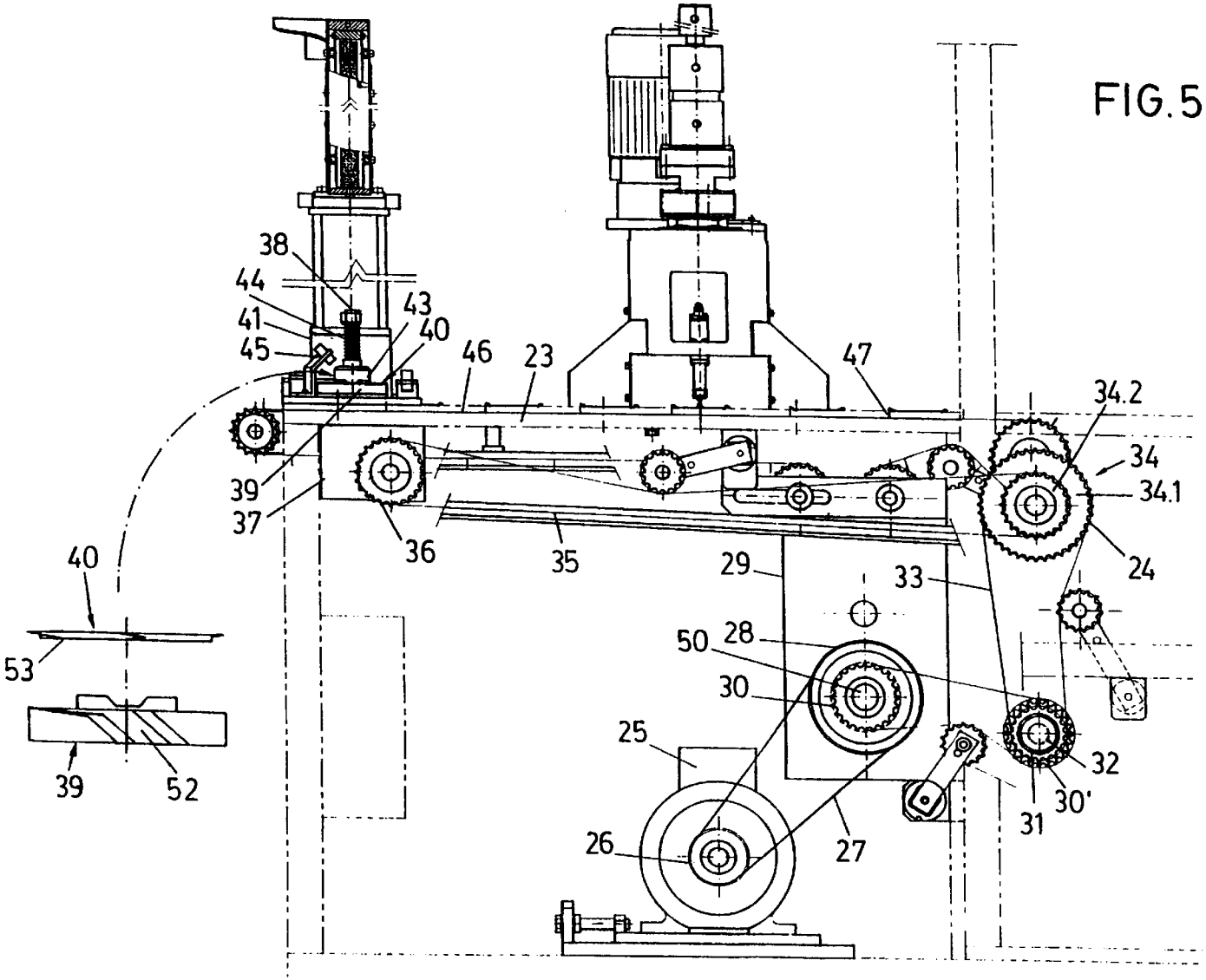
FIG. 5 is a side elevation sketch of the revarnisher with an enlargement of the lid positioner and the blade.
Figure 6:
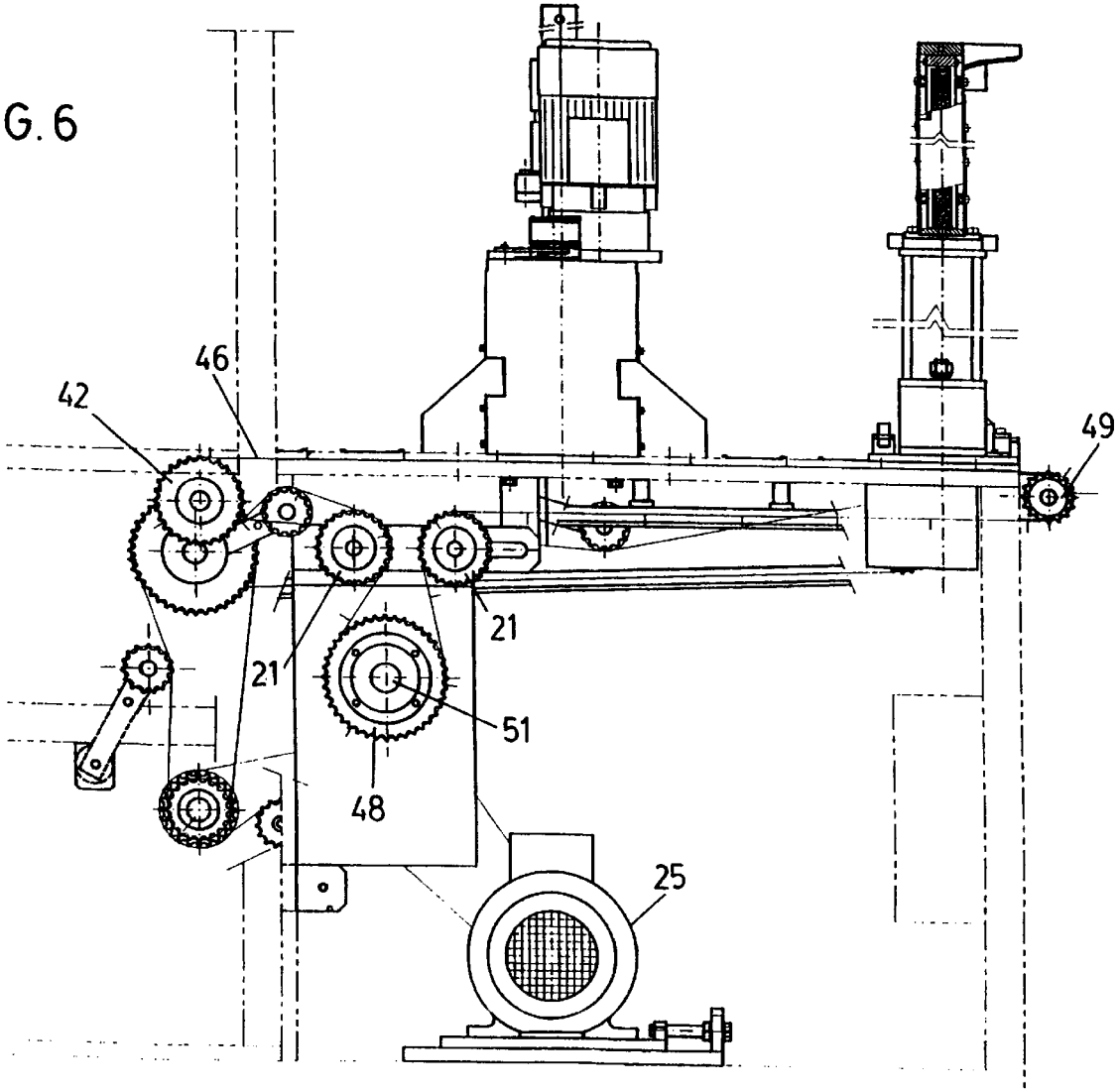
FIG. 6 is the opposite side elevation sketch of the revarnisher.
Figure 7:
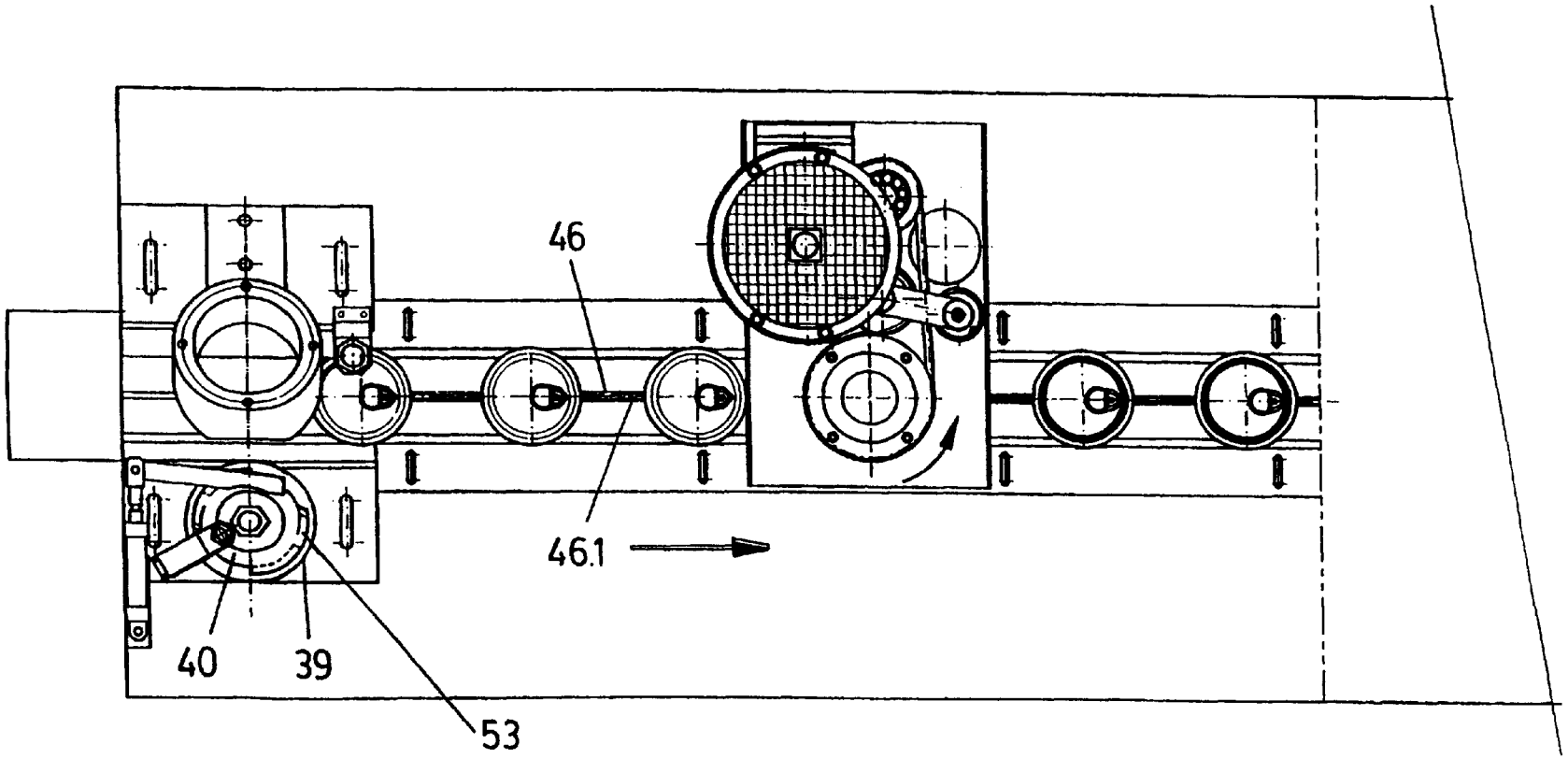
FIG. 7 is a plan of the baseplate with a cross section of the single revarnishing head.
Figure 8:
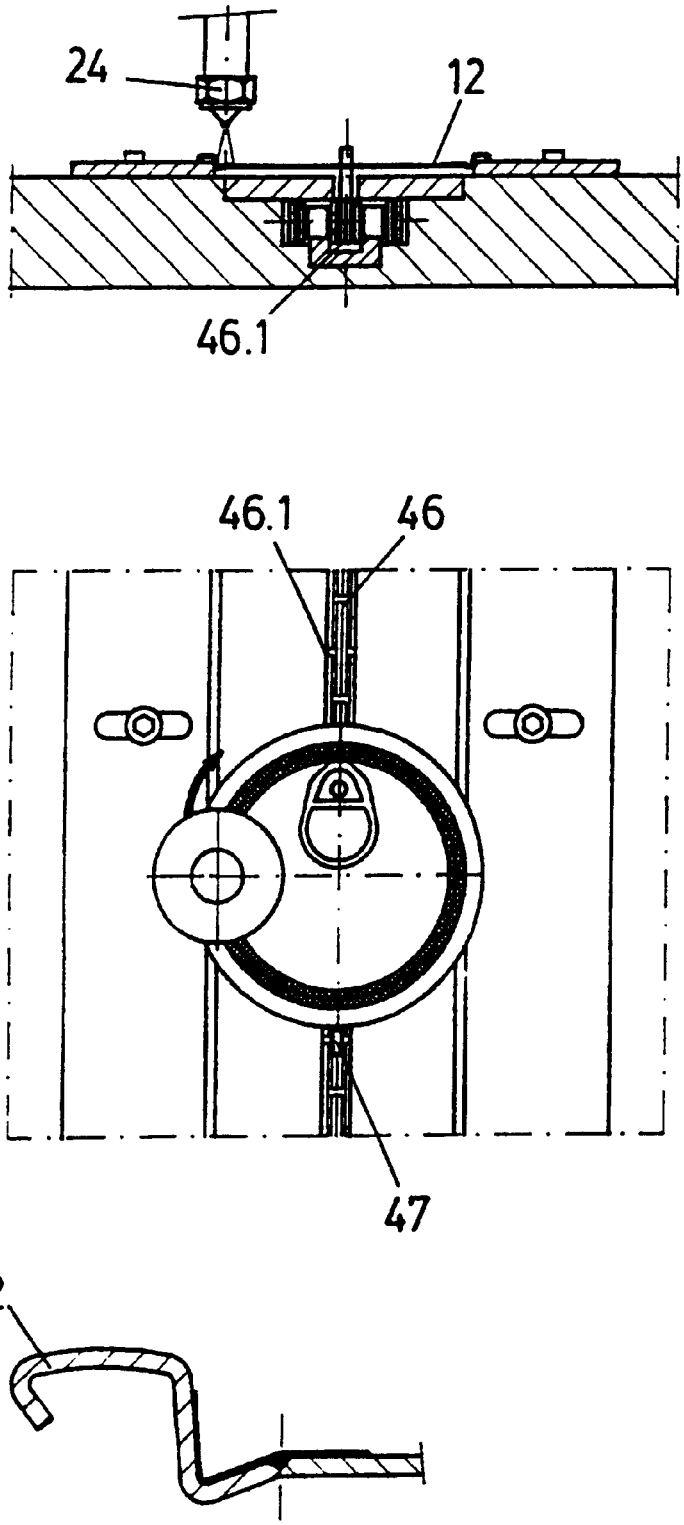
FIG. 8 is an enlargement of the revarnishing process with three different views, an elevation with an enlargement and a plan of a cross section of the baseplate with a lid.

In view of the above, the present invention relates to a revarnishing machine for easy opening lids, among the revarnishing machines which use varnish projection nozzles, characterised in that it is provided with a single or double revolving revarnishing head and a lid transportation device.

The lid revarnishing revolving head is characterised in that it applies varnish to the lids on the circular incision of diameter between 52.5 and 99 mm.

The revolving head is mounted on a fixed support (1) to the revarnishing bench and to which is joined another circular support (4), on the upper part of which is an electric motor (6) to which is connected a toothed pulley (16) by a conical slip (20), with support (4) open in front to facilitate transmission by a toothed belt to the other pulleys.

Toothed pulley (16) is engaged by a toothed belt (17) to a pulley (13) and to a tensor pulley (14) provided with bearings (22). Tensor pulley (14) is coupled to a conventional tensor (19) and attached to support (1) of the head by a shaft or a bolt, belt (17) also being engaged to pulley (15) which transmits the motion to a slip on which is a revolving shaft (3), slip (2) having an opening in its lower front area to house the pneumatic revarnishing gun (10), which is laterally connected to the lower end of shaft (3) with the interposition of an additional separator (11) of an adjustable size, depending on the diameter of the lid (12) to be varnished.

Additional separator (11) moves gun (19) with respect to its rotation axis, being applicable preferably to types of lid (12) with diameters of 65.00, 73.15, 83.00, and 99.00 mm, or without separator (11) for lids of diameter 52.5 mm.

Slip (2) is mounted on two conical roller bearings (8) which absorb all axial and radial loads produced during operation of the revolving head, roller bearings (8) being tightly fitted so that as slip (2) turns with respect to the inner race of the roller bearing, shaft (3) turns with it, so that the revarnishing gun (10) describes a circular motion.

Gun (10) is provided with a thin nozzle (24) for applying the varnish to lid (12), with the varnish projection following a: conical geometry, adjusting the height of gun (10) with respect to bench (23) between an upper and lower heights by a screw (5) inserted in a drill which is placed in the lower end of the shaft (3), so that when screw (5) is turned the shaft is displaced downwards with the consequent displacement of gun (10) while, in the opposite sense, gun (10) is separated with respect to the surface of baseplate (23).

A cover (9) and ajoint located on the lower face of slip (2) seal the inside of the head and avoid accumulation of the spray produced in varnishing.

A screw (18) connects slip (2) to one of the conical roller bearings (8).

A three stage revolving joint (7), coupled to the stop of the inner shaft of head (3) is provided with two orifices for inlet and return of varnish and another for air inlet for the pneumatic gun (10), this joint being formed by three bodies, two upper fixed bodies and a lower mobile body, which turns together with the inner shaft of head (3).

The other device characteristic of this invention is the lid conveyor on the baseplate of the revarnisher, complemented by a drive chain to the lid feeder.

A second electric motor (25) is coupled to a toothed pulley (26) which is connected by a toothed belt (27) to another pulley (28) located in the inlet axis of an intermittent wheel race, which starts and stops, and which has two shafts (50), (51) located in opposite faces and at different heights, an inlet shaft (50) and an outlet shaft (51).

Inlet shaft (50) turns continuously while outlet shaft (51) receives the motion made intermittent by a cam-follower device incorporated in wheel race (29) so that in each revolution of the inlet shaft (50), outlet shaft (51) starts and stops once, turning ¼ of a revolution, facilitating varnishing of the lids one at a time.

A double crown gear (30) coupled to inlet shaft (50) of wheel race (29), transmits the first motion through a pair of links to another gear (30') located on a distributor shaft which is coupled to a gear (31) which, through a link chain (33), transmits the motion to another double crown gear (34).

In this way gear (31) transmits the motion to the larger crown (34.1) while the crown with fewer teeth (34.2) connected to it turns, passing the motion through drive chain (35) to the lid feeder (35), to a single crown gear (36) located on the shaft of the feeder box (37).

Feeder box (37) drives a shaft (38) connected to a lid positioner (39) and a dosing blade (40) placed on top, both in the shape of a disc, positioner (39) being provided with two helical channel grooves (52) located on its side at 180°, while blade (40) has a constant thickness along the surface, except in four sections, where there are peripheral flaps (53) of variable thickness.

Flaps (53), two inlet and two outlet, of blade (40) collect and separate lids (12) from the feeding tower (41), inserting them below into one of the channel grooves (52) of positioner (39).

The motion of lid positioner (39) and dosing blade (40) is received from a pair of helical contact gears placed on two perpendicular axes, on the feeder box shaft and on shaft (38).

Shaft (38) is provided with a torque limiter (43) on which acts a spring (44), so that when positioner (43) is blocked limiter (43) moves from its natural position and an inductive sensor (45) which acts by proximity generates a signal and automatically stops the machine.

The lid conveyor is located in the geometrical centre of lid (12) revarnishing baseplate (23) and moves these lids by a transporting link chain (46) placed on a central groove (46.1) which is provided with pull flaps (47) for lids (12) placed equidistant from each other along the drive and receiving an intermittent, start-stop motion in the outlet shaft (51) of the wheel race (29) by a double crown drive gear (48) complemented by two other gears (49) and (42) located on the ends of the conveyor, plus another two double crown gears (21) placed next to the drive gear (48), one of which acts as a tensor gear, the set of gears and conveyor chain (46) forming a loop around the outlet shaft (51) of intermittent wheel race (29).

The description is not extended in the understanding that any expert in the matter would have enough information to understand the scope of this invention and the advantages derived thereof, as well as to be able to reproduce it.

It is understood that, as far as they do not change the essence of the invention, variations in materials, shape, size and arrangement of the elements are subject to variation within the same characterisation.

The terms used in the description and its meaning must always be taken in a non limiting manner.

What is claimed is:

1. Revarnishing machine for easy opening lids, of the type using varnish projection nozzles, a single or double revolving revarnishing head and a lid transporting device, characterized in that it is provided with a revarnishing gun (10), with or without an additional separator (11) of variable thickness depending on the size of lid (12), which applies the varnish to the lids in a circular motion on the diameter of the incision and conical projection of adjustable height, also provided with a lid transporting device with a motor (25) connected to an intermittent wheel race (29) whose outlet shaft (51) provides an intermittent motion to a conveyor chain (46) with pull flaps (47) to varnish lids (12) one at a time, complemented by a drive chain (35) associated to a feeder box (37) which drives a shaft (38) of a lid positioner (39) and a dosing blade (40) which collects and separates the lids arriving from a feeder tower (41) and inserts them in a groove of the positioner (39) which supplies them to the lid transporting device, characterized in that the revolving head is coupled to a support (1) joined to the revarnishing bench and on which is coupled another circular support (4), on the upper part of which is an electric motor (6) which is joined to a toothed pulley (16) by a conical slip (20), the front face of support (4) being open in order to facilitate the toothed belt transmission to other pulleys, wherein the toothed pulley (16) is engaged through a toothed belt (17) to a pulley (13) and a tensor Pulley (14), provided with bearings (22), tensor pulley (14) being connected to a conventional tensor (19) and joined to head support (1) by a shaft or bolt, and in that the toothed belt (17) engages pulley (15) which transmits the motion to a slip (2) with a revolving shaft (3), slip (2) having an opening in its lower front part for the revarnishing gun (10), which is laterally connected to the lower end of shaft (3) with an interposed additional separator (11) of a variable thickness depending on the size of the lid (12) to be varnished.

2. Revarnishing machine for easy opening lids, as claimed in claim 1, characterised in that slip (2) is mounted on two conical roller bearings (8) Which absorb axial and radial loads, these bearings (8) being tightly fitted with slip (2) mounted on their inner race with which turn the slip and the shaft (3), producing the circular motion of the revarnishing gun (10).

3. Revarnishing machine for easy opening lids, as claimed in claim 2, characterised in that gun (10) is provided with a thin orifice nozzle (24) for applying the varnish on the lid (12), the varnish projection following a conical geometry, incorporating a screw (5) in a drill on the lower part of shaft (3) which adjusts as it turns the height of gun (10) with respect to bench (23) between an upper and lower eights.

4. Revarnishing machine for easy opening lids, as claimed in claim 3, characterised in that it is provided with a cover (9) and a joint on the bottom face of slip (2) which seal the inside of the head.

5. Revarnishing machine for easy opening lids, as claimed in claim 4, characterised in that it is provided with a screw (18) which connects slip (2) to one of the conical roller bearings (8).

6. Revarnishing machine for easy opening lids, as claimed in claim 5, characterised in that it incorporates a three stage revolving joint (7) connected to head shaft (3), with two orifices for inlet and outlet of the varnish and another for air for gun (10), this joint (7) being formed by three bodies, two upper fixed bodies and a lower mobile body which turns with the inner shaft (3) of the head, while the connections for varnish and air are made in the two fixed bodies.

7. Revarnishing machine for easy opening lids, as claimed in claim 1, characterised in that the lid transporting device on the revarnisher baseplate has a second electric motor (25) coupled to a toothed pulley (26) which in turn is connected through a toothed belt (27) to another pulley (28) located in the inlet shaft of an intermittent wheel race (29) which starts and stops, with an inlet shaft (50) and an outlet shaft (51) located in opposite faces and at different heights.

8. Revarnishing machine for easy opening lids, as claimed in claim 7, characterized in that the intermittent wheel race is provided with a cam-follower mechanism which transforms the motion of the inlet shaft (50) into the intermittent motion of the outlet shaft (51) to facilitate varnishing the lids one at a time.

9. Revarnishing machine for easy opening lids, as claimed in claim 8, characterized in that it is provided with a double crown gear (30) coupled to the inlet shaft (50) of wheel race (29) through a link chain which transmits the first motion to another gear (30') located on a distributor shaft (32) coupled to a gear (31) which transmits the motion through a link chain (33) to another double crown gear (34).

10. Revarnishing machine for easy opening lids, as claimed in claim 9, characterized in that it is provided with a chain which transmits the motion of gear (31) to a larger crown (34.1) which is connected to a crown (34.2) with fewer teeth, on which engages the lid feeder chain (35), and also a single crown gear (36) located on the shaft of the feeder box (37).

11. Revarnishing machine for easy opening lids, as claimed in claim 10, characterized in that the feeder box (37) drives shaft (38) where a lid positioner (39) and an above dosing blade (40) are connected, both in disc form, positioner (39) having two helical grooves (52) on the side at 180°, while blade (40) has constant thickness along the surface, except in four sections where it is provided with peripheral flaps (53) of variable thickness, two inlet and two outlet which collect and separate lids (12) arriving from the feeder tower (41) and insert them in one of the grooves (52) of the positioner.

12. Revarnishing machine for easy opening lids, as claimed in claim 11, characterized in that shaft (38) has a torque limiter (43) upon which acts a spring (44) which is released when positioner (39) is blocked, also incorporating an inductive sensor (45) which detects the release of spring (44) and generates a signal to stop the machine.

13. Revarnishing machine for easy opening lids, as claimed in claim 12, characterized in that the lid transporting device is located in the geometrical centre of the lid revarnishing baseplate (23) and moves these with a conveyor link chain (46) placed on a central groove (46.1) which has attached pull flaps (47) for lids (12), placed equidistant to each other along the transmission, and which receives a start and stop intermittent motion in the outlet shaft of wheel race (29) by a double crown drive gear (48), complemented by two more gears (49) and (42) located on the ends of the conveyor, plus another two gears (21), also double crowned, located next to the drive gear (48), one of them acting as tensor gear, the set of gears and conveyor chain (46) forming a loop around the rotation axis of wheel race (29).

* * * * *